US005211699A

United States Patent [19]

Tipton

[11] Patent Number: 5,211,699

[45] Date of Patent: May 18, 1993

[54] LIGHTED DRINKING GLASS

[76] Inventor: Tommy B. Tipton, Rte. 1 Box 112, Flatonia, Tex. 78941

[21] Appl. No.: 888,601

[22] Filed: May 27, 1992

[51] Int. Cl.[5] ..... F21V 33/00

[52] U.S. Cl. ..... 362/101; 362/800; 362/802; 362/806; 362/31

[58] Field of Search ..... 362/101, 800, 276, 802, 362/295, 31, 227, 806

[56] References Cited

U.S. PATENT DOCUMENTS

| | | | |
|---|---|---|---|
| 2,224,319 | 12/1940 | Schroyer | 362/101 |
| 3,218,447 | 11/1965 | Pardue | 362/101 |
| 3,878,386 | 4/1975 | Douglas | 362/101 |
| 4,034,213 | 7/1977 | Norris | 362/101 |
| 4,344,113 | 8/1982 | Ditto et al. | 362/101 |
| 4,390,928 | 6/1983 | Runge | 362/205 |
| 4,563,726 | 1/1986 | Newcomb et al. | 362/34 |
| 4,858,084 | 8/1989 | Sheryll | 362/101 |
| 4,922,355 | 5/1990 | Dietz et al. | 362/101 |
| 5,070,435 | 12/1991 | Weller | 362/101 |
| 5,119,279 | 6/1992 | Makowsky | 362/101 |

FOREIGN PATENT DOCUMENTS

| | | | |
|---|---|---|---|
| 701798 | 1/1941 | Fed. Rep. of Germany | 362/101 |
| 1516076 | 1/1968 | France | 362/101 |

*Primary Examiner*—Richard R. Cole
*Attorney, Agent, or Firm*—Norman B. Rainer

[57] ABSTRACT

A drinking glass which provides an appealing illuminated effect has a side wall portion containing recessed wedge-shaped indicia. Light emitting diodes, positioned at the bottom of the side wall portion direct light upwardly in a manner to be reflected outwardly by virtue of the angled facets of the wedge-shaped recesses. A battery for activating the diodes is positioned in a sealable compartment in the base of the glass. A mercury-type tilt switch causes the diodes to be illuminated when the glass is in upright orientation, and causes the diodes to be deactivated when the glass is upside down.

1 Claim, 2 Drawing Sheets

LIGHTED DRINKING GLASS

BACKGROUND OF THE INVENTION

1. Field of the Invention

This invention concerns a drinking glass having self-contained means in the bottom of the glass for illuminating the sidewall of the glass.

2. Description of the Prior Art

Pedestal and coaster devices for illuminating a drinking glass seated thereupon to produce a novel lighting effect have been disclosed in U.S. Pat. Nos. 3,878,386; 4,344,113 and 4,858,084. In such devices, the light emergent from the underlying support device is directed upwardly through the center of the glass. U.S. Pat. Nos. 4,563,726 and 4,922,355 disclose drinking glasses which have light-emitting means incorporated into the bottom of the glass. As in the case of the pedestal-type illuminating devices, the light is directed upwardly through the center of the glass. Such centralized illumination of a beverage in a glass produces an interesting shimmering, or chemiluminescent light effect. Any indicia on the sidewall of the glass is seen as an indistinctive opaque silhouette profile.

It is an object of the present invention to provide a drinking glass having a sidewall containing indicia which can be intensely illuminated.

It is a further object of this invention to provide a drinking glass as in the foregoing object wherein the illuminated indicia provides a 3-dimensional or depth effect.

It is another object of the present invention to provide a drinking glass of the aforesaid nature wherein the lighting mechanism is incorporated into the bottom of the glass.

It is a still further object of this invention to provide a drinking glass of the aforesaid nature which is easy to clean and is amenable to low cost manufacture.

These objects and other objects and advantages of the invention will be apparent from the following description.

SUMMARY OF THE INVENTION

The above and other beneficial objects and advantages are accomplished in accordance with the present invention by a drinking glass comprising:

a) an elongated sidewall portion of circular contour having a center axis of symmetry and extending between an uppermost or lip extremity and a lowermost extremity, said sidewall portion being bounded in part by opposed interior and exterior surfaces, b) indicia formed as recesses in said sidewall portion, said recesses emergent upon said exterior surface and extending in depth partially through said sidewall toward said interior surface, said recesses defined by facets which in part are angled with respect to said axis, c) a base portion joining the lowermost extremity of the sidewall portion as a continuous integral extension thereof, and having an impervious sealable compartment and flat bottom surface, d) a lighting mechanism housed within said compartment and comprised of a re-chargeable battery and at least one light-emitting diode activated by said battery and disposed beneath the lowermost extremity of said sidewall portion, e) a switch mechanism confined within said compartment and causing said light-emitting diode to be energized when the glass is upright on its base portion, and de-activating said diode when the glass is turned upside down, and f) a removable, sealable access panel disposed upon the lower surface of said base portion to provide access to said compartment.

In preferred embodiments, the drinking glass is fabricated of a transparent plastic such as polyacrylate or polycarbonate polymer. The base portion may have a socket to accommodate a probe for re-charging the battery. The base portion may also incorporate solar cells such as those employed in small computers. When the drinking glass is in its upside down, stored state, ambient illumination acting upon the solar cells serves to charge the battery.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
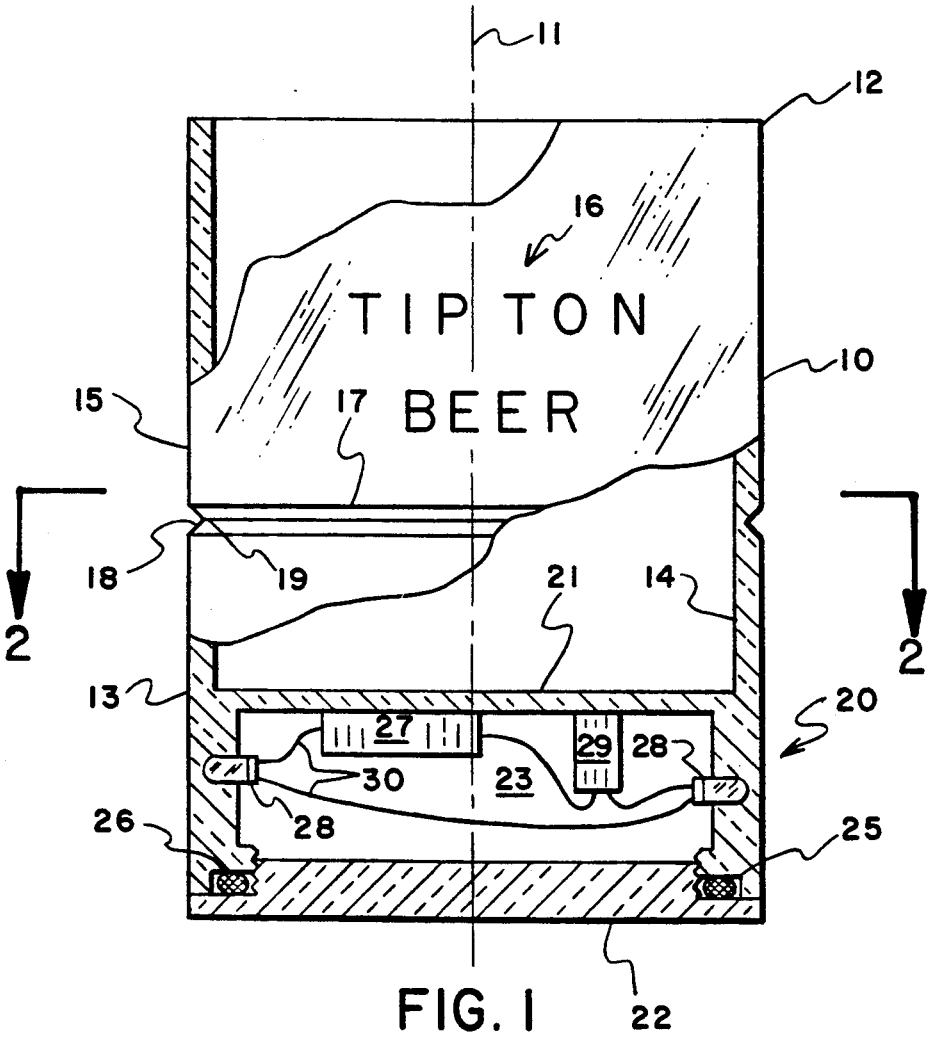
FIG. 1 is a partial vertical sectional view of an embodiment of a drinking glass of the present invention.
Figure 2:
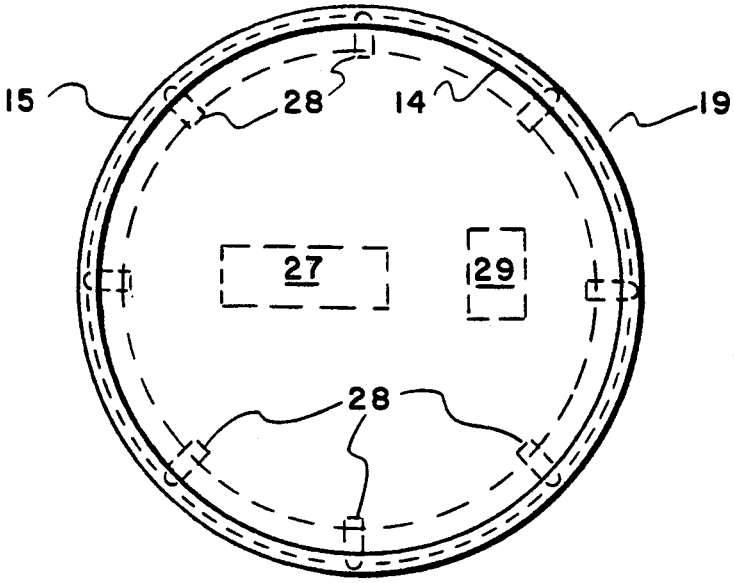
FIG. 2 is a horizontal sectional view taken in the direction of the arrows upon the line 2—2 of FIG. 1.

Referring to FIGS. 1 and 2, an embodiment of the drinking glass of the present invention is shown comprised of elongated sidewall portion 10 of circular cylindrical contour having a center axis of symmetry 11 and extending between an uppermost lip extremity 12 and a lowermost extremity 13. Said sidewall portion is bounded in part by opposed interior and exterior surfaces 14 and 15, respectively.

Indicia 16, which may be of advertising content, is engraved into exterior surface 15. In the illustrated embodiment, a decorative engraved band 17 encircles the sidewall as part of indicia 16. The nature of the engraving is such that, when magnified, a V or wedge-shaped contour 18 is carved, molded or otherwise formed in the sidewall in a manner whereby the walls or facets of the wedge are angled with respect to axis 11. The innermost penetration of the engraving, or apex 19 of the wedge configuration may be located at a distance within the sidewall representing between about 10% and 40% of the thickness of the sidewall. The expression "Tipton Beer", shown in FIG. 1 is similarly engraved so as to have facets angularly disposed to said axis.

A base portion 20 joins the lowermost extremity of the sidewall portion as a continuous integral extension thereof. Said base portion, in the embodiment of FIGS. 1 and 2, is bounded in part by opaque upper panel 21 that joins with said sidewall to constitute therewith a liquid-impervious vessel, and a flat lower panel 22 orthogonally disposed to said axis and defining with said upper panel an impervious sealable compartment 23. In the illustrated embodiment, lower panel 22 further serves as a threadably removable disc which acts in conjunction with O-ring 25 and annular abutment shoulder 26 to form an impervious closure of compartment 23.

A lighting mechanism confined within compartment 23 is comprised of re-chargeable battery 27 and a series of light emitting diodes 28 activated by said battery and equidistantly disposed in a circular array beneath sidewall portion 10. A switch mechanism 29, preferably a mercury tilt switch, is confined within compartment 23 and adapted to complete an electrical circuit between said battery and diodes when the glass is upright and disconnect said circuit when the glass is turned upside down whereby the glass rests upon the lip of the sidewall. Electrical conductors 30, which may be wires or printed conductive paths, compete the circuitry between the switch, battery and diodes.

In certain embodiments, a charging socket may penetrate compartment 23 in a manner to re-charge battery 27. Also, solar cells may be incorporated into compartment 23, facing toward disc 24, so that, when the glass is upside down, the cells will utilize ambient light to re-charge the battery. The base portion is otherwise opaque, thereby concealing the contents of compartment 23.

In operation, when the glass is right side up, the light emitted from the diodes passes upwardly through the sidewall, and emerges at the sites of engraving. The angled facets of the engraving reflect light outwardly from the glass, thereby creating a very distinctive lighting effect. Such effect is enhanced by opaque upper panel 21 of the base portion, which prevents light from entering the interior region of the glass and tends to concentrate the light in the sidewall.

Figure 3:
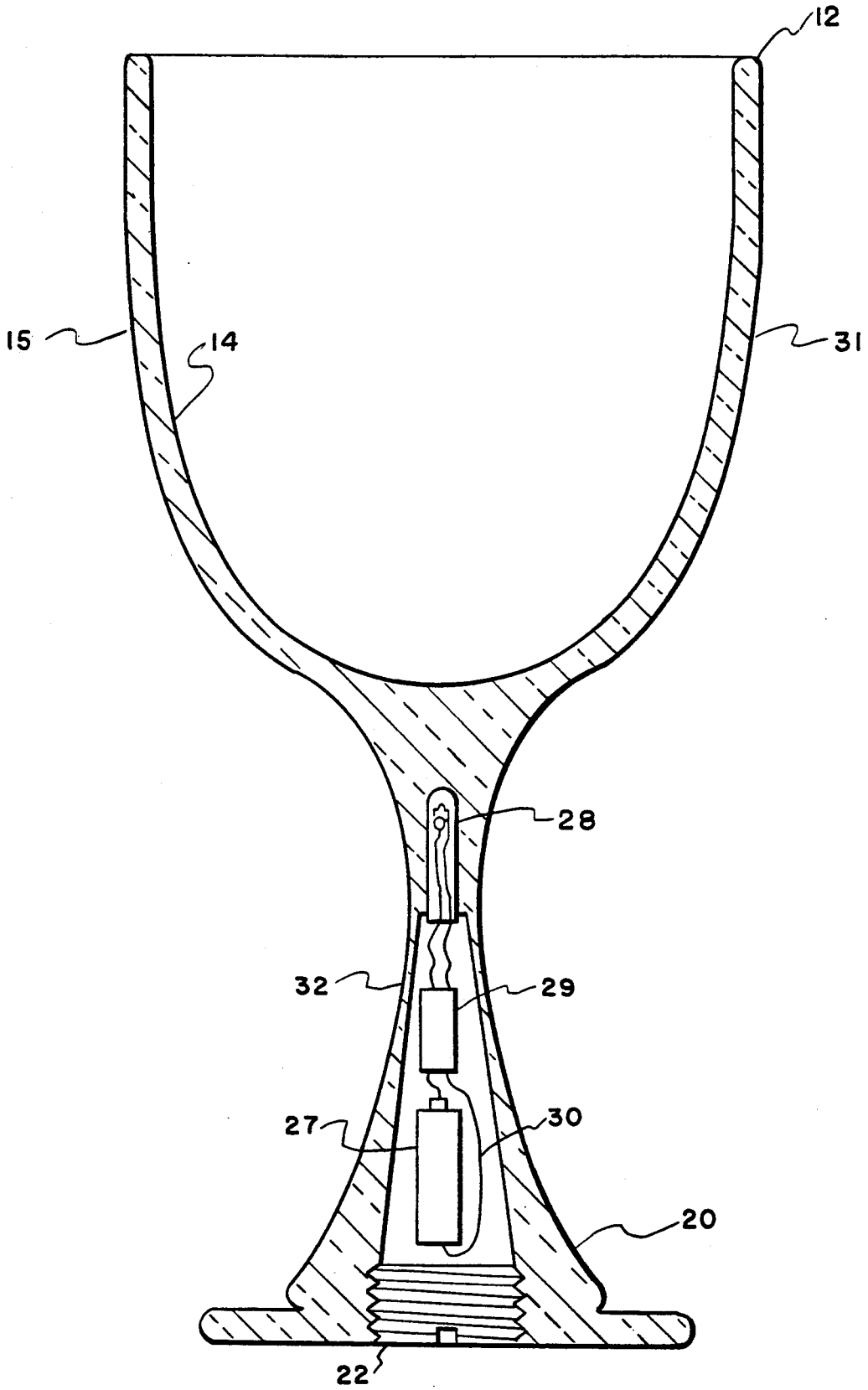
FIG. 3 is a vertical sectional view of an alternative embodiment of the drinking glass of this invention.

In the alternative embodiment of FIG. 3, the same general principles that have been described with respect to a tubular-type cylindrical-walled drinking glass are applied to a stemmed wine glass. In the case of the wine glass, a single diode is employed where the bottom of curved vessel portion 31 attaches to stem portion 32. The lighting system is incorporated into the stem portion.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A drinking glass fabricated of optically transparent plastic material and comprising:

a) an elongated sidewall portion of circular cylindrical contour having a center axis of symmetry and extending between an uppermost lip extremity and a lowermost extremity, said sidewall portion being bounded in part by opposed interior and exterior surfaces, b) indicia formed as recesses in said sidewall portion, said recesses emergent upon said exterior surface and extending in depth between about 10% and 40% through said sidewall toward said interior surface, said recesses defined by facets which in part are angled with respect to said axis, c) a base portion joining the lowermost extremity of the sidewall portion as a continuous integral extension thereof, and comprised of: 1) an opaque upper panel that joins with said sidewall to constitute therewith a liquid-impervious vessel, 2) an impervious sealable compartment and 3) a flat lower panel, d) a lighting mechanism housed within said compartment and comprised of a battery and a plurality of light-emitting diodes disposed beneath the lowermost extremity of said sidewall portion and equidistantly spaced about said sidewall portion, said diodes activated by said battery, e) a switch mechanism confined within said compartment and causing said light emitting diodes to be energized when the glass is upright on its base portion, and deactivating said diodes when the glass is turned upside down, and f) a threadably removable, sealable access panel associated with said base portion to provide access to said compartment.

* * * * *